United States Patent [19]

Best et al.

[11] Patent Number: 4,990,018

[45] Date of Patent: Feb. 5, 1991

[54] MULTIPLE RING BINDER ADAPTER FOR NEGATIVE

[75] Inventors: Scott Best, Troy; James F. Turner, Farmington, both of Mich.

[73] Assignee: Saxon, Inc., Ferndale, Mich.

[21] Appl. No.: 451,295

[22] Filed: Dec. 14, 1989

[51] Int. Cl.[5] ..... B42F 3/00

[52] U.S. Cl. ..... 402/79; 283/81; 402/500

[58] Field of Search ..... 283/81; 402/80 R, 79, 402/501, 500

[56] References Cited

U.S. PATENT DOCUMENTS

| | | | |
|---|---|---|---|
| 1,843,771 | 2/1932 | Kline | 402/79 |
| 1,977,794 | 10/1934 | Garraway | 402/79 X |
| 2,762,372 | 9/1956 | Jochim | 402/79 X |
| 3,315,683 | 4/1967 | Rodriguez et al. | 402/79 X |
| 4,533,048 | 8/1985 | Ozeki | 402/79 X |
| 4,580,815 | 4/1986 | Barber | 283/81 |
| 4,629,070 | 12/1986 | Roberg | 402/79 X |
| 4,907,825 | 3/1990 | Miles et al. | 283/81 X |

FOREIGN PATENT DOCUMENTS

| | | | |
|---|---|---|---|
| 2543066 | 9/1984 | France | 402/500 |

*Primary Examiner*—Paul A. Bell

*Attorney, Agent, or Firm*—Reising, Ethington, Barnard, Perry & Milton

[57] ABSTRACT

A photographic image holding sleeve (12) is adapted to be compatible with a multiple ring binder. The adaptor assembly (10) is a single sheet of mylar having a smooth surface (26) and an adhesive surface (24). The adhesive surface (24) is covered by a backing (32). The backing (32) is divided into two sections, the first section (34) being smaller than the second section (36). The first section (34) is removed so the adapter assembly (10) may be aligned properly and uniformly. The second section (36) is removed and the adapter assembly (10) is folded over itself (10) and the photographic image holding sleeve (12).

11 Claims, 2 Drawing Sheets

MULTIPLE RING BINDER ADAPTER FOR NEGATIVE

TECHNICAL FIELD

This invention relates to adapters used for modifying photographic image holding sleeves for incorporation in a multiple ring binder. More particularly, this invention relates to a photographic image holding sleeve adapter having an adhesive layer that folds over itself and the photographic image holding sleeve.

BACKGROUND ART

With the popularization of the automatic and semi-automatic 35 mm cameras, many film developing companies attempted to capture more of the film developing market by offering incentives such as overnight service, one-hour processing, double prints and free enlargements, among others. One such incentive is the negative or slide holding sleeves, i.e., negative sleeves. The negative sleeve resulted from a need to handle the negatives without damaging them. Prior to this time, not many amateur photographers where interested in such protective packages because the negatives, themselves, where not of good quality.

The negative sleeves are awkward and difficult to store. U.S. Pat. No. 3,797,146, issued on Mar. 19, 1974 to Holes and U.S. Pat. No. 4,419,837 issued on Dec. 13, 1983 to Meeker disclose pages suitable for organizing information carrying items. Each of these patents, however, disclose a page format in conjunction with the type of binding. There is no patent disclosing an adapter which may be attached to a negative sleeve and stored in a multiple ring binder.

SUMMARY OF THE INVENTION AND ADVANTAGES

An adapter assembly for modifying a photographic image holding sleeve for storage in a storage container comprises a sheet-like tear resistant material having an adhesive surface. The assembly also comprises a longitudinal fold means for accurately folding the adapter assembly onto itself and the photographic image holding sleeve. A mounting means is included for mounting the assembly to a multiple ring binder. A backing means is placed over the adhesive surface of the sheet-like tear resistant material and the backing means is divided into a first section and a second section. This backing means is removably attached to the adhesive surface. The backing means includes a separation line means for separating and distinguishing the first section from the second section and is characterized by being parallel to and spaced apart from the longitudinal fold means.

The subject invention overcomes the disadvantages inherent in the prior art, specifically the page adapter, by having the areas of the first and second sections being of unequal length. When the first section of backing means is removed, the majority of the adhesive layer on the sheet-like tear resistant material is still covered; thus, allowing the user to easily and accurately apply the negative sleeves to the adapter assembly. Without this first section being smaller than the second section, the page adapters are frequently wasted, and the ones that are properly applied have no means for uniformly attaching the photographic imaging holding sleeve. The resulting organization of such adapters is sloppy display showing many uneven edges.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
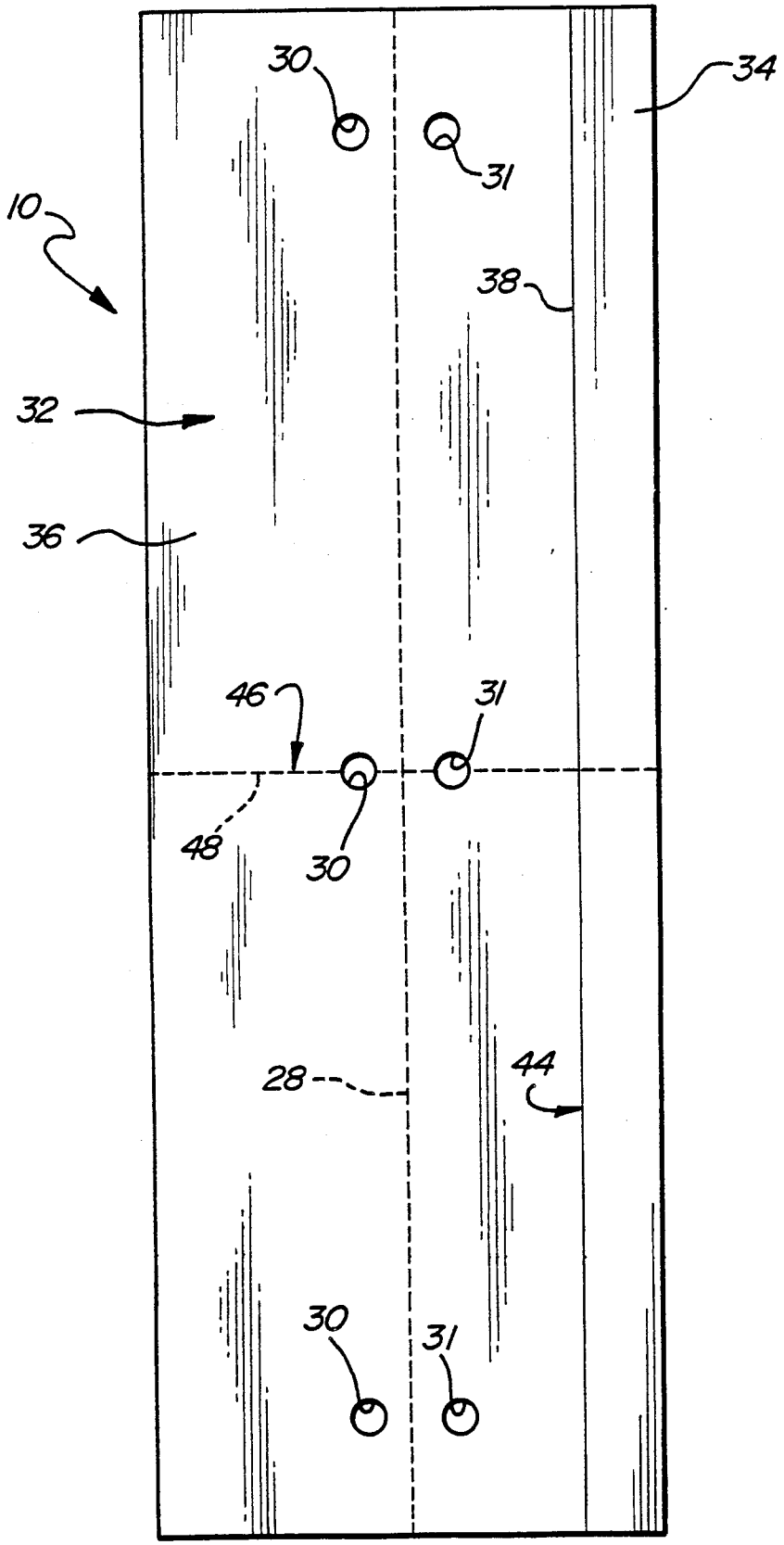
FIG. 1 is a plan view of the preferred embodiment of the subject invention.
Figure 2:
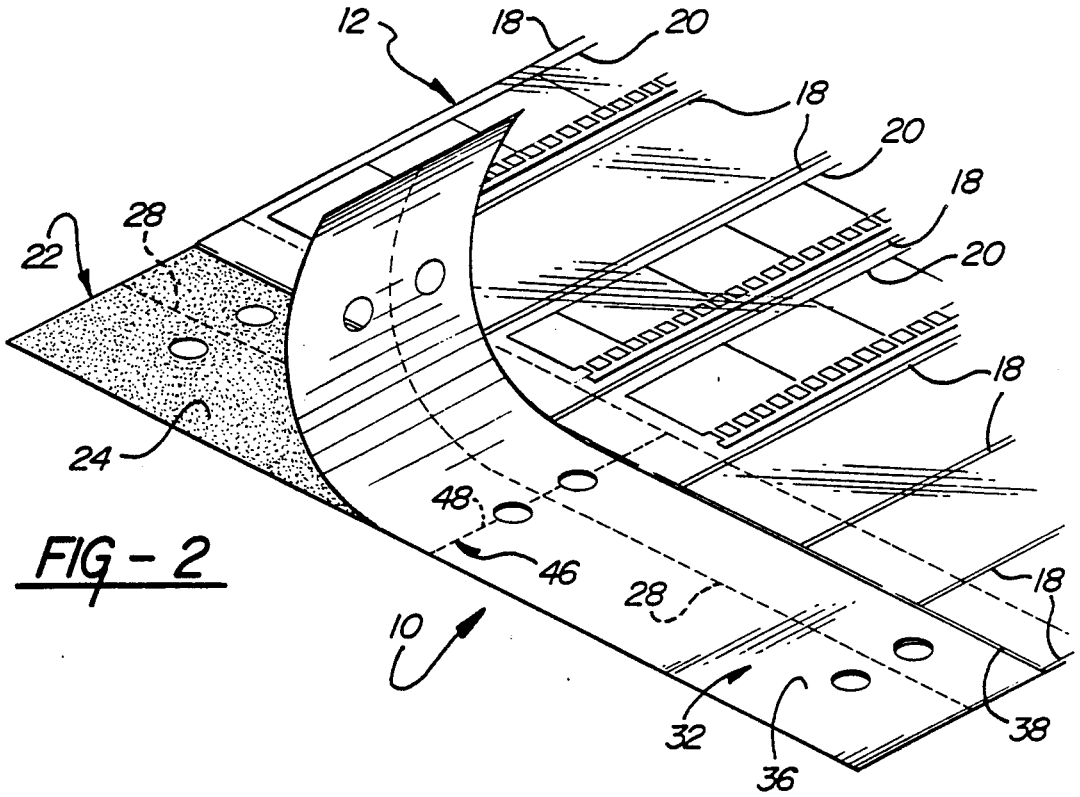
FIG. 2 is a fragmentary perspective view of the preferred embodiment of the subject invention illustrating the first section of the backing means being attached to a photographic image holding sleeve.
Figure 3:
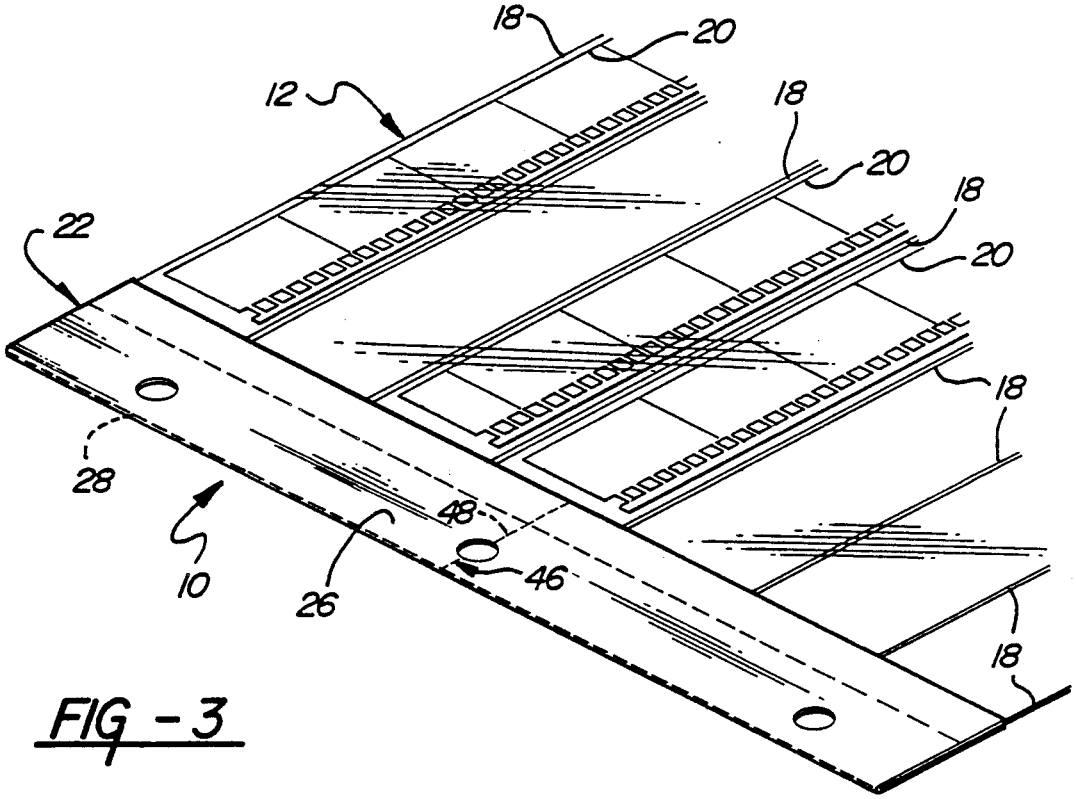
FIG. 3 is a fragmentary perspective view of the preferred embodiment of the subject invention in its operating state.

Referring to the Figures, an adapter assembly is generally shown at 10. This adapter assembly 10 is used for modifying a photographic image holding sleeve 12 so it may be stored in a multiple ring binder (not shown). A photographic image holding sleeve 12 typically includes two sheets of plastic material heat pressed along the seams 18 to provide individual negative sleeves 12 for negatives 20. This sheet-like tear resistant material 22 is typically made from polymeric materials, such as Mylar. This sheet-like tear resistant material 22 has two surfaces, one being an adhesive surface 24 and the other being a smooth surface 26. In operation, the smooth surface 26 will be the surface handle by the operator.

The adapter assembly 10 further includes a longitudinal fold means 28 for accurately folding the adapter assembly 10 onto itself 10 and the photographic image holding sleeve 12. A mounting means 30, 31 is used for mounting the adapter assembly 10 in a multiple ring binder (not shown). Attached to the adhesive surface 24 is a backing means 32. The backing means 32 is separated into a first section 34 and a second section 36 by separation line means 38. The backing means 32 is removably attached to the adhesive surface 24 of the sheet-like tear resistant material 22. The separation line means 38 is parallel to and spaced apart from the longitudinal fold means 28.

The longitudinal fold means 28 includes a longitudinal fold line 28 which extends the length of the adapter assembly 10. In the preferred embodiment, the longitudinal fold line 28 may be created by a perforation method. Another possible method to create the longitudinal fold line 28 would be to reduce the thickness of the adapter assembly 10, such as scoring.

The mounting means 30, 31 used to mount the adapter assembly 10 into a multiple ring binder (not shown) includes hole means. The hole means has two sets of holes 30, 31. These sets of holes 30, 31 have an equal number of holes 30, 31. The two sets of holes 30, 31 are separated by the longitudinal fold line 28. The two sets of holes 30, 31 are spaced in such a manner that, absent the separation line means 38, the adapter assembly 10 to one side of the longitudinal fold line 28 is the mere image of the adapter assembly 10 to the other side of the longitudinal fold line 28. In other words, the two sets of holes 30, 31 are spaced an equal distance on either side of the longitudinal fold line 28 whereby the two sets of holes 30, 31 become one set of holes when the adapter assembly 10 is folded upon itself 10 along the longitudinal fold line 28.

The first section 34 and the second section 36 of the backing means 32 have different amounts of area. The first section 34 has a substantially smaller area than the second section 36. In other words, the area defined by the periphery 44 of the first section 34 can be described as to exclude the hole means 30, 31 and the longitudinal fold line 28. The first section 34 excludes the hole means 30, 31 and the longitudinal fold line 28 because, in operation, the first section 34 will be attached to the photographic image holding sleeve 12 in its entirety.

The separation line means 38, which separates the first section 34 from the second section 36, is separate and distinct from the longitudinal fold line 28. In the preferred embodiment, the separation line means 38 is substantially parallel to the longitudinal fold line 28.

The adapter assembly 10 also includes a lateral or transverse axis 46. A transverse fold means 48 is placed along the transverse axis 46 for compactly storing the adapter assembly 10 in an envelope the size of which is used to distribute the developed photographic images, such as photographic negatives and prints.

The first step in modifying a photographic image holding sleeve 12 is to remove the first section 34 of the backing 32. This reveals the first section of the adhesive surface 24. Since the first section 34 of the backing means 32 is smaller than the second section 36, the majority of the adhesive surface 24 is still covered.

The first section 34 of the adhesive surface 24 is then applied to the photographic image holding sleeve 12 when the photographic image holding sleeve 12 is properly attached to the first section 34, the second section 36 of the backing means 32 is removed, thus exposing the remaining adhesive surface 24. The adapter assembly 10 is folded over itself 10 and the photographic image holding sleeve 12 along the longitudinal fold line 28. The second section 36 of the adhesive surface 24 is completely covered by this step. The method of adapting the photographic image holding sleeve 12 is complete, at which point the modified photographic holding sleeve 12 may be placed into a multiple ring binder (not shown).

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. An adapter assembly (10) for modifying a photographic image holding sleeve (12) for storage in a storage container said assembly comprising:

sheet-like tear resistent material (22) having an adhesive surface (24);

longitudinal fold means (28) for accurately folding said adapter assembly (10) onto itself (10) and the photographic image holding sleeve (12);

mounting means (30, 31) for mounting said assembly (10) in a multiple ring binder;

backing means (32) having a first section (34) and a second section (36) removably attached to said adhesive surface (24);

separation line means (38) for separating and for distinguishing said first section (34) from said second section (36), said assembly (10) characterized by said separation line means (38) being parallel to and spaced apart from said longitudinal fold means (28).

2. An assembly (10) as set forth in claim 1 further characterized by said mounting means (30, 31) comprising hole means (30, 31) for mounting said assembly (10) in a multiple ring binder.

3. An assembly (10) as set forth in claim 2 further characterized by said hole means (30, 31) having two sets (30, 31) of holes (30, 31) for mounting said assembly (10) into a multiple ring binder.

4. An assembly (10) as set forth in claim 3 further characterized by said separation line means (38) being separated from said longitudinal fold means (28) by one of said two sets (30, 31) of holes (30, 31).

5. An assembly (10) as set forth in claim 4 further characterized by said two sets (30, 31) of holes (30, 31) being separated by said longitudinal fold means (28).

6. An assembly (10) as set forth in claim 5 further characterized by said first section (34) having a substantially smaller area than said second section (36).

7. An assembly (10) as set forth in claim 6 further characterized by said first section (34) further including a periphery (44) wherein the area of said first section 34 defined by said periphery (44) excludes said hole means (30, 31) and said longitudinal fold means (28).

8. An assembly (10) as set forth in claim 7 further characterized by said two sets (30, 31) of holes (30, 31) being spaced an equal distance on either side of said longitudinal fold means (28) whereby said two sets (40, 42) of holes (30, 31) becomes one set of holes (30, 31) when said assembly (10) is folded upon itself along said longitudinal fold means (28).

9. An assembly (10) as set forth in claim 8 further characterized by said adapter assembly (10) having a transverse axis (46) with a fold means (48) therealong for compactly storing said adapter assembly (10).

10. A method of modifying a photographic image holding sleeve (12) using an adapter assembly (10) having a sheet-like tear resistent material (22) with an adhesive surface (24) with a longitudinal fold line (28) and a backing (32) divided by a separation line (38) into a first section (34) and a second section (36) removably attached thereto delineating a first section (34) and a second section (36) of the adhesive layer (24) for organized storage in a multiple ring binder comprising the steps of:

removing the first section (34) of the backing (32) revealing the first section of the adhesive layer (24);

applying the first section (34) of adhesive layer to the photographic image holding sleeve (12);

removing the second section (36) of backing revealing the second section (36) of the adhesive layer;

folding the adapter assembly (10) along the longitudinal axis (28) wherein the adhesive surface (24) between the longitudinal fold line (28) and the separation line (38) is fixedly secured to a portion of the adhesive surface (24) on the side opposite the longitudinal fold line (28) with the remaining portion of adhesive surface (24) on the opposite side of the longitudinal fold line (28) being fixedly attached to the negative sleeve (12).

11. A method as set forth in claim 10 further characterized by mounting the adapter assembly (10) and the photographic image holding sleeve (12) to a multiple ring binder.

* * * * *